US007438677B2

(12) United States Patent
Fujiwara

(10) Patent No.: US 7,438,677 B2
(45) Date of Patent: Oct. 21, 2008

(54) CHOPPER TABLE

(75) Inventor: Kenji Fujiwara, Noda (JP)

(73) Assignee: Komori Corporation, Tokyo (JP)

( * ) Notice: Subject to any disclaimer, the term of this patent is extended or adjusted under 35 U.S.C. 154(b) by 471 days.

(21) Appl. No.: 10/890,141

(22) Filed: Jul. 14, 2004

(65) Prior Publication Data

US 2005/0011323 A1 Jan. 20, 2005

(30) Foreign Application Priority Data

Jul. 15, 2003 (JP) ..... 2003-196928

(51) Int. Cl.
*B31F 1/10* (2006.01)

(52) U.S. Cl. ..... 493/434; 493/444; 493/478

(58) Field of Classification Search ..... 493/434, 493/444, 457, 442, 443, 445, 478
See application file for complete search history.

(56) References Cited

U.S. PATENT DOCUMENTS

| | | | | |
|---|---|---|---|---|
| 3,632,104 | A * | 1/1972 | Dufour | 493/444 |
| 3,901,501 | A * | 8/1975 | Kistner | 493/444 |
| 4,405,304 | A * | 9/1983 | Bensberg et al. | 493/476 |
| 4,419,088 | A | 12/1983 | Nemec | |
| 4,452,597 | A * | 6/1984 | Achelpohl | 493/204 |
| 4,643,705 | A * | 2/1987 | Bober | 493/444 |
| 5,222,934 | A * | 6/1993 | Ochsner | 493/444 |
| 6,309,336 | B1 * | 10/2001 | Muessig et al. | 493/444 |
| 7,022,059 | B2 * | 4/2006 | Kitai et al. | 493/444 |

FOREIGN PATENT DOCUMENTS

| | | | |
|---|---|---|---|
| EP | 1197459 | A2 | 4/2002 |
| JP | 58-17064 | A | 2/1983 |
| JP | 7-206173 | A | 8/1995 |
| JP | 11-29258 | A | 2/1999 |
| JP | 2001-80823 | A | 3/2001 |

* cited by examiner

*Primary Examiner*—Sameh H. Tawfik
(74) *Attorney, Agent, or Firm*—Birch, Stewart, Kolasch & Birch, LLP

(57) ABSTRACT

A chopper table comprises table bodies for guiding a signature transported by transport belts, and a pair of inlet guides for guiding the signature pushed in by a chopper blade. The table bodies are detachably supported on chopper frames, and the inlet guides are detachably supported on the chopper frames via brackets. The chopper table improves the return ability of the table body and inlet guide when they are removed at the time of a paper jam or replacement of the transport belt, and can easily adjust the gap of a slit between the inlet guides.

3 Claims, 11 Drawing Sheets

CHOPPER TABLE

CROSS REFERENCE TO RELATED APPLICATION

The entire disclosure of Japanese Patent Application No. 2003-196928 filed on Jul. 15, 2003, including specification, claims, drawings, and summary, is incorporated herein by reference in its entirety.

BACKGROUND OF THE INVENTION

1. Field of the Invention

This invention relates to a chopper table in a chopper device within a folder.

2. Description of the Related Art

In a rotary press, a folder for folding a printed web is generally installed. Such a folder is provided with a chopper device for further folding a signature, which is a cut and folded web. A chopper table for discharging the transported signature downward is mounted on a portion of the chopper device where the signature is folded. Such a chopper table is described in Japanese Patent Application Laid-Open No. 1999-29258.

An example of the above-mentioned chopper table is shown in FIGS. 9, 10, and 11. FIG. 9 is a plan view, and FIG. 10 is a sectional view taken on line X-X of FIG. 9. FIG. 11 is a schematic side view of a chopper device. The direction of transport of a signature is indicated by an open arrow in FIG. 9. A chopper table 51 is composed of a pair of table bodies 52, and a pair of inlet guides 53 attached to the respective table bodies 52 and opposed to each other. The pair of inlet guides 53 are located nearly centrally of the pair of table bodies 52. The right and left sides of the pair of inlet guides 53 are supported on the table bodies 52 by bolts 54*a* via brackets 55 which are connecting members. Each of the table bodies 52 is supported on chopper frames 56 by bolts 54*b*.

A signature 57, which is a sheet, is sandwiched between a plurality of transport belts 58 traveling in pairs formed vertically, and is transported along the chopper table 51. When the signature 57 is brought close to a stopper (not shown) installed on a downstream side, in the transport direction, of the chopper table, a chopper blade 59 lowers from above the chopper table 51. The chopper blade 59 pushes a nearly central portion of the signature 57 into a slit 53*a*, which is a clearance formed between the pair of inlet guides 53. The signature 57 pushed in passes while being bent by folding rollers 60 installed below the inlet guides 53.

According to the above-described features of the chopper table, the inlet guides 53 are supported on the table bodies 52 by the bolts 54*a* via the brackets 55, and the table bodies 52 are supported on the chopper frames 56 by the bolts 54*b*. If, in the so configured chopper table 51, the signature 57 becomes jammed between the folding rollers 60, it suffices to detach only the inlet guide 53. When mounted again, the inlet guide 53 is returned to the original position, and the gap of the slit 53*a* remains unchanged. To replace the transport belt 58, however, the table body 52 is removed, and thus the inlet guide 53 is also dismounted simultaneously. Moreover, holes of the table body 52, into which the bolts 54*b* are inserted, are formed as slots so that the gap of the slit 53*a* formed between the pair of inlet guides 53 can be adjusted. Thus, in an operation for mounting the table body 52 on the chopper frames 56, it is difficult to ensure accuracy and to return the gap of the slit 53*a* to the original state. This requires readjustment, meaning tiresome procedure. Hence, the table body 52 and the inlet guide 53 lack returnability; namely, they cannot be mounted at the original positions. Also, many man-hours are involved in the mounting operation, thus requiring much time and labor, and adjustment of the gap is difficult.

SUMMARY OF THE INVENTION

The present invention has been accomplished in view of the above-described problems. Its object is to provide a chopper table which improves the returnability of a table body and an inlet guide after their removal at the time of a paper jam or replacement of a transport belt, and which can easily adjust the gap of a slit between the inlet guides.

In a first aspect of the present invention for attaining the above object, there is provided a chopper table comprising:

a guide table for guiding a sheet transported by transport means; and a pair of guides for guiding the sheet pushed in by a chopper blade, wherein the guide table is detachably supported on a locking member, and each of the guides is detachably supported on the locking member via adjusting means for adjusting a gap formed between the pair of guides.

According to this aspect, the guide table and the guide can be removed separately. Thus, even when the guide table is removed, the guide keeps supported via the adjusting means. Hence, the gap of the slit between the pair of guides remains unchanged.

In a second aspect of the invention, slots extending in a direction perpendicular to the longitudinal direction of the gap formed between the pair of guides may be formed in the adjusting means, and the guide may be movable along the direction of extension of the slots and in a direction perpendicular to the direction of transport of the sheet, with the guide being fixed to the adjusting means. According to this aspect, the gap of the slit can be adjusted in the direction perpendicular to the direction of transport, and the guide can be removed without changing the gap of the slit. That is, even when the guide is removed, the position of support of the bracket does not change. Thus, the returnability of the guide is retained.

In a third aspect of the invention, the guide may be adapted to be mounted on and removed from the adjusting means, and the position of the guide relative to the adjusting means may be determined by positioning means so that the guide is mounted at the same position as the original position of the guide before being removed.

In a fourth aspect of the invention, the positioning means may comprise a bolt and a hole, and ahead of the bolt for supporting the guide on the adjusting means may be fitted into the hole formed in the guide.

In a fifth aspect of the invention, the positioning means may have holes for insertion of a bolt, and the guide may have an opening hole for access to the bolt.

In a sixth aspect of the invention, a slot extending in a direction perpendicular to the longitudinal direction of the gap formed between the pair of guides may be formed in the guide, and the guide may be movable along the direction of extension of the slot and in a direction perpendicular to a direction of transport of the sheet.

In a seventh aspect of the invention, a bracket supported by the adjusting means may be adapted to be mounted on and removed from the locking member, and the position of the bracket relative to the locking member may be determined by positioning means so that the bracket is mounted at the same position as the original position of the bracket before being removed.

In an eighth aspect of the invention, the positioning means may comprise a bolt and holes, and a head of the bolt for supporting the bracket on the locking member may be fitted into the holes formed in the bracket.

In a ninth aspect of the invention, the bracket may have holes for insertion of a bolt, and the guide may have an opening hole for access to the bolt.

In a tenth aspect of the invention, the positioning means may have the bolt comprising a head and a threaded portion, and may have the lower hole which communicates with the upper hole, which allows insertion thereinto of the threaded portion of the bolt, and which has a smaller diameter than the diameter of the upper hole, and the head of the bolt may be accommodated in the upper hole.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Embodiments of the present invention will now be described in detail with reference to the accompanying drawings, which in no way limit the invention.

First Embodiment

Figure 1:
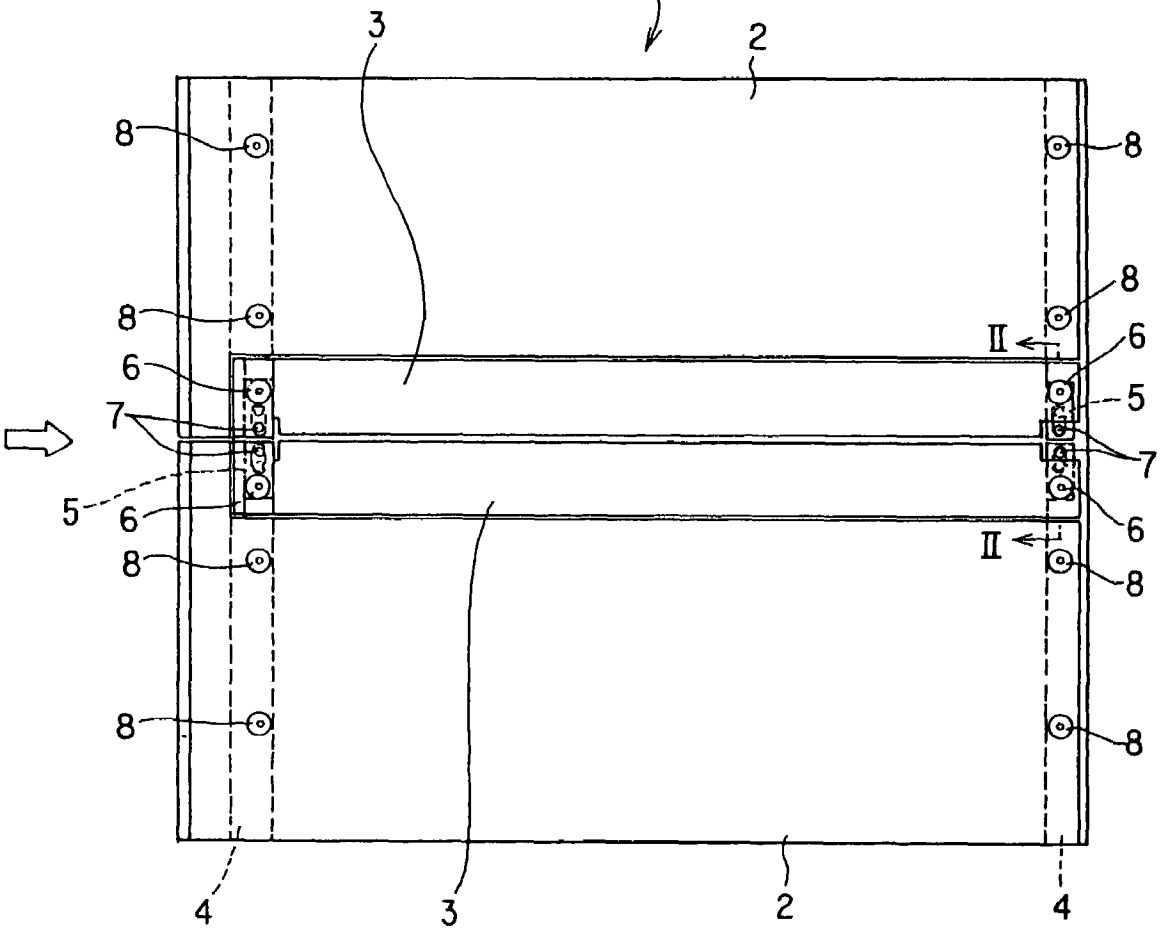
FIG. 1 is a plan view of a chopper table according to an embodiment of the present invention.
Figure 2:
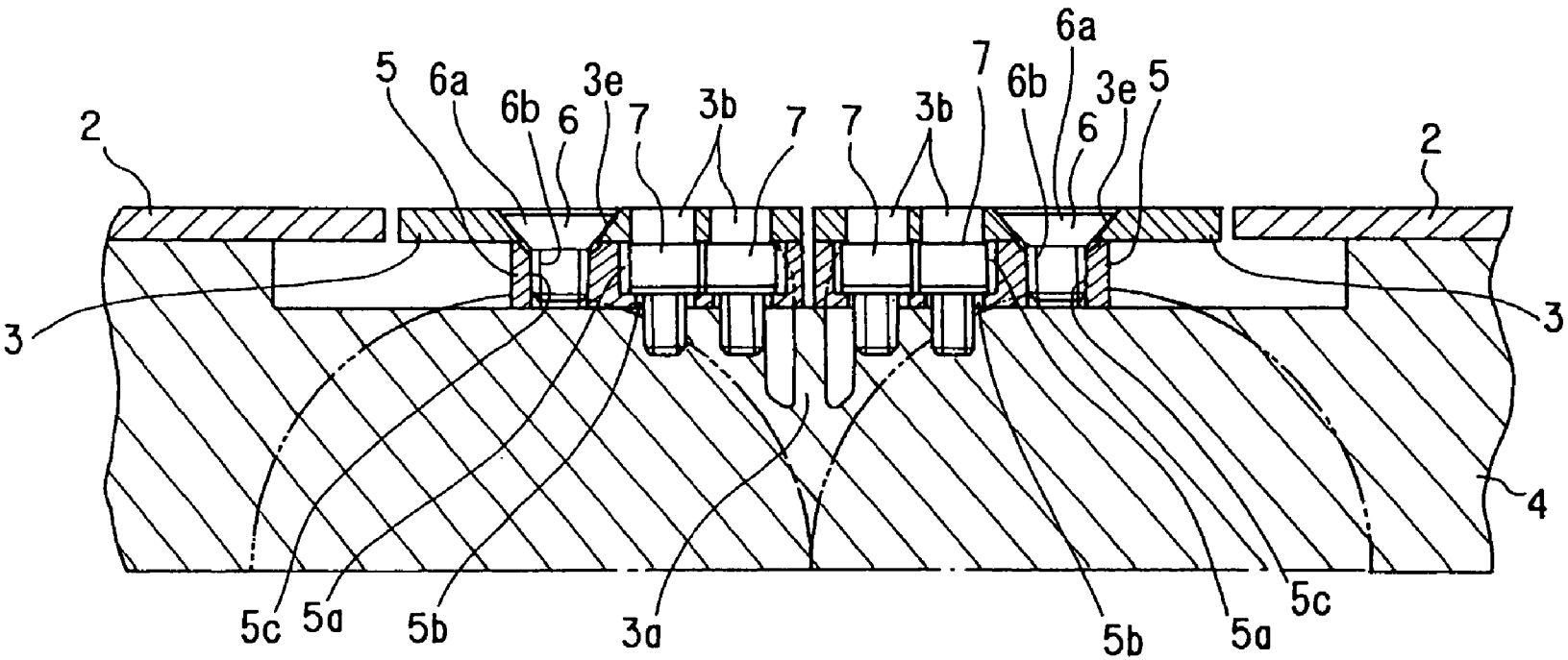
FIG. 2 is a sectional view taken along line II-II of FIG. 1.
Figure 3:
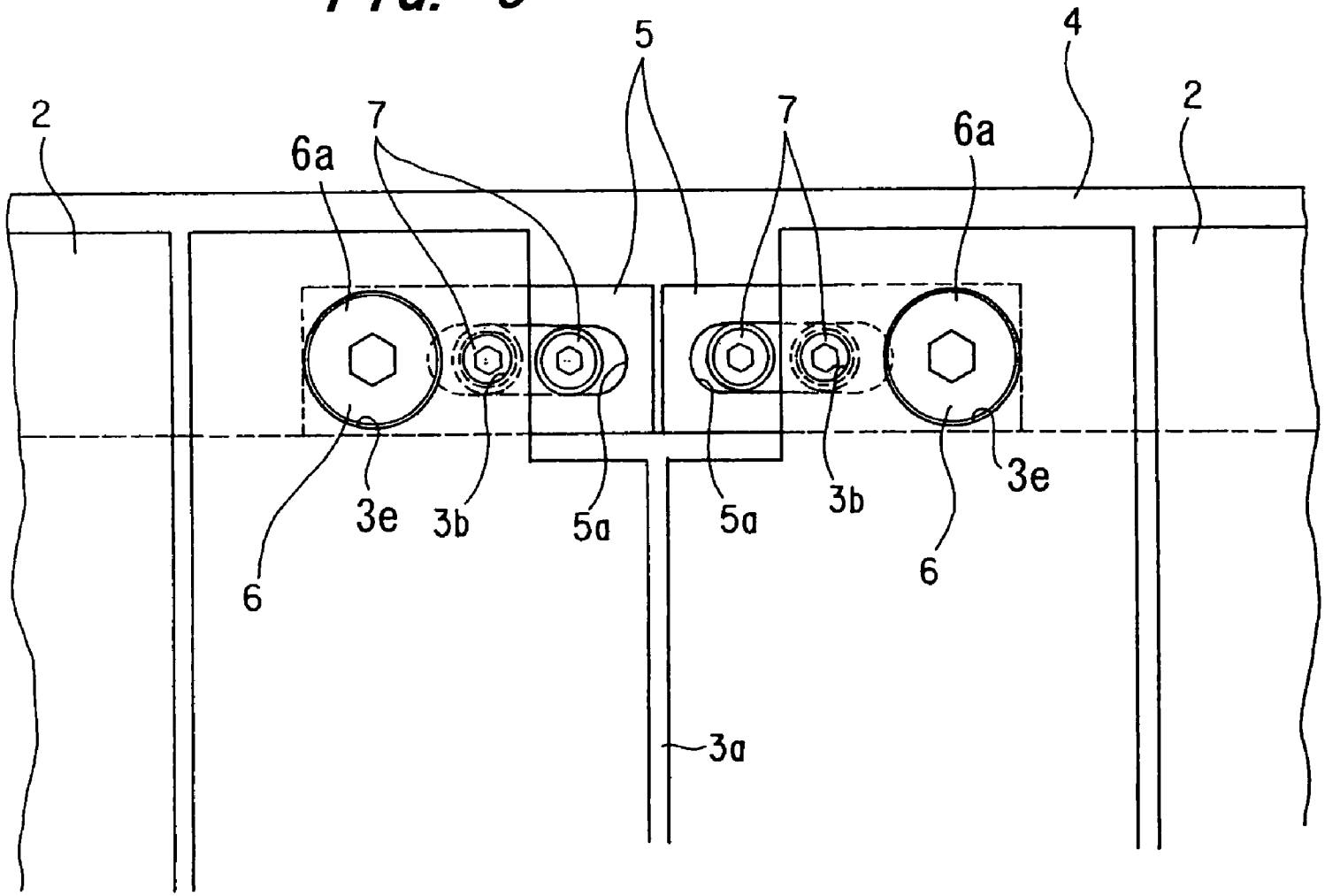
FIG. 3 is a plan view of FIG. 2.
Figure 8:
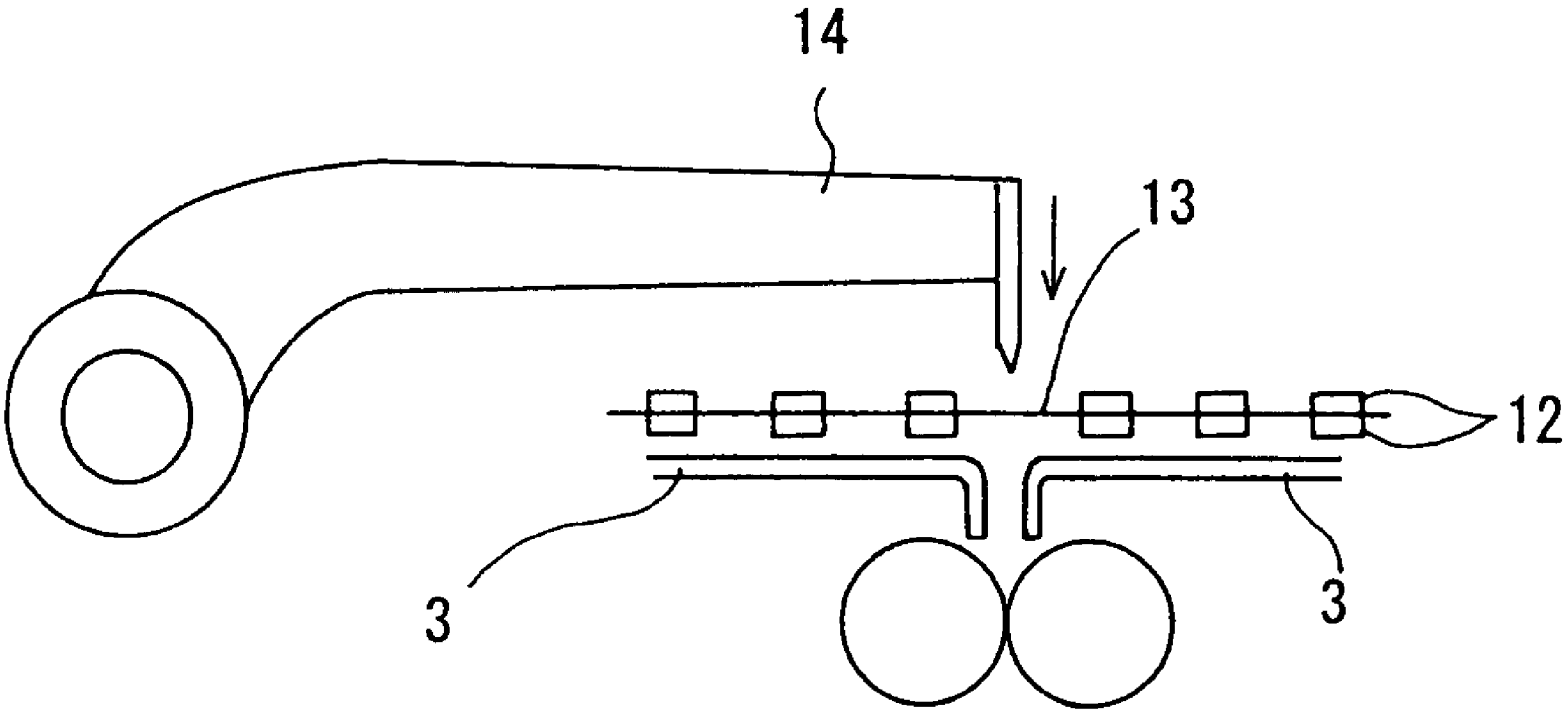
FIG. 8 is a schematic side view of a chopper device equipped with the chopper table according to the present invention.
Figure 9:
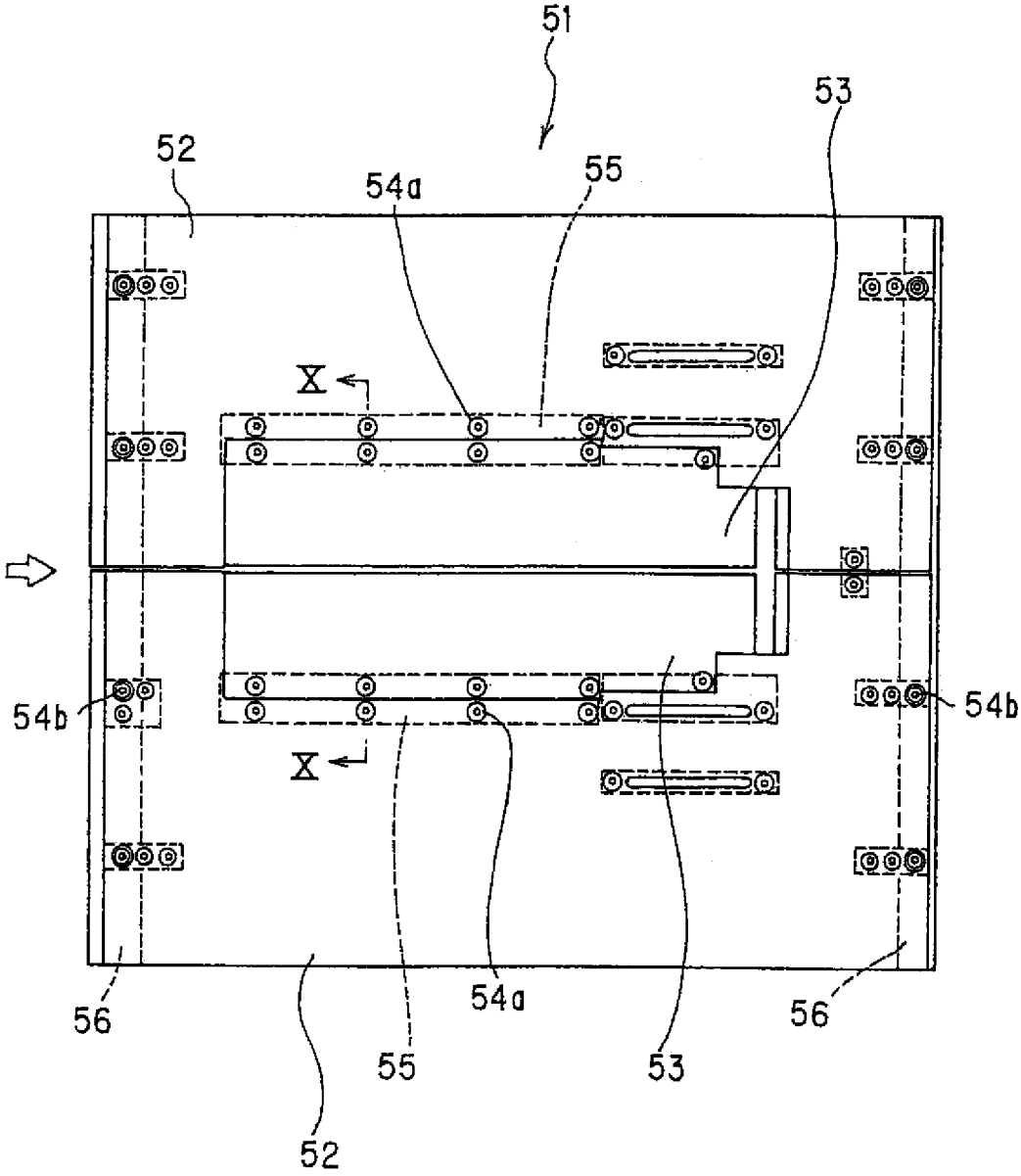
FIG. 9 Prior Art
FIG. 9 is a plan view of a conventional chopper table.
Figure 10:
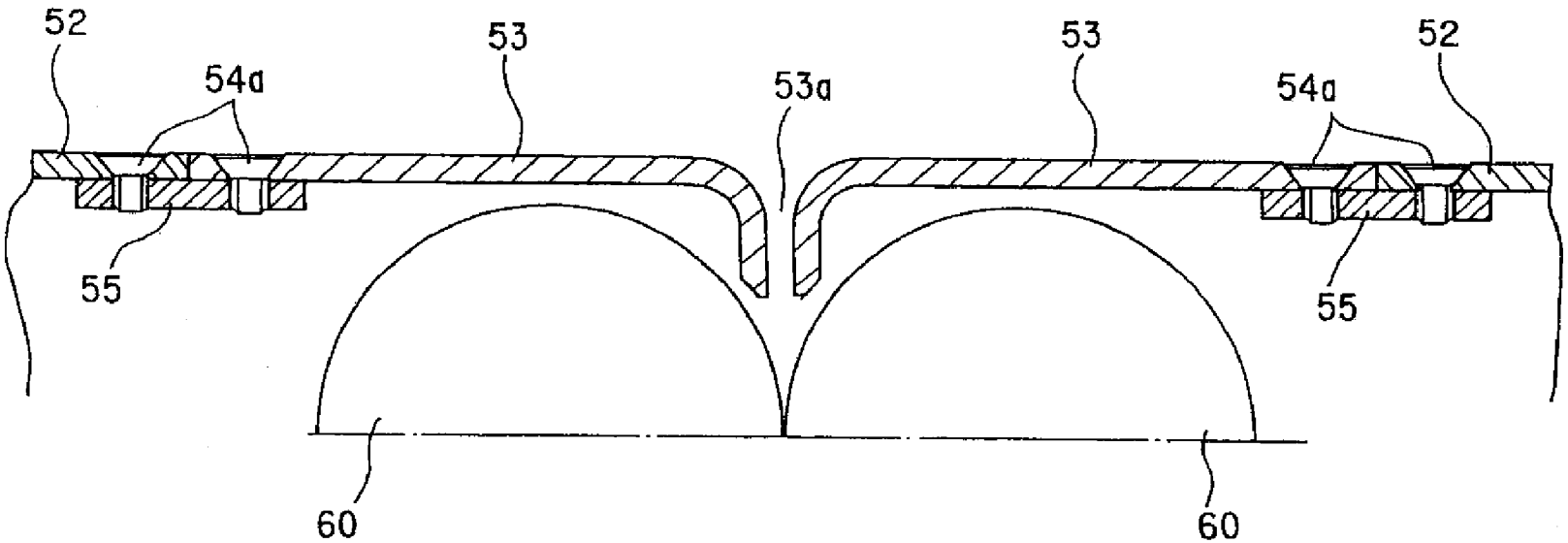
FIG. 10 Prior Art
FIG. 10 is a sectional view taken along line X-X of FIG. 9.
Figure 11:
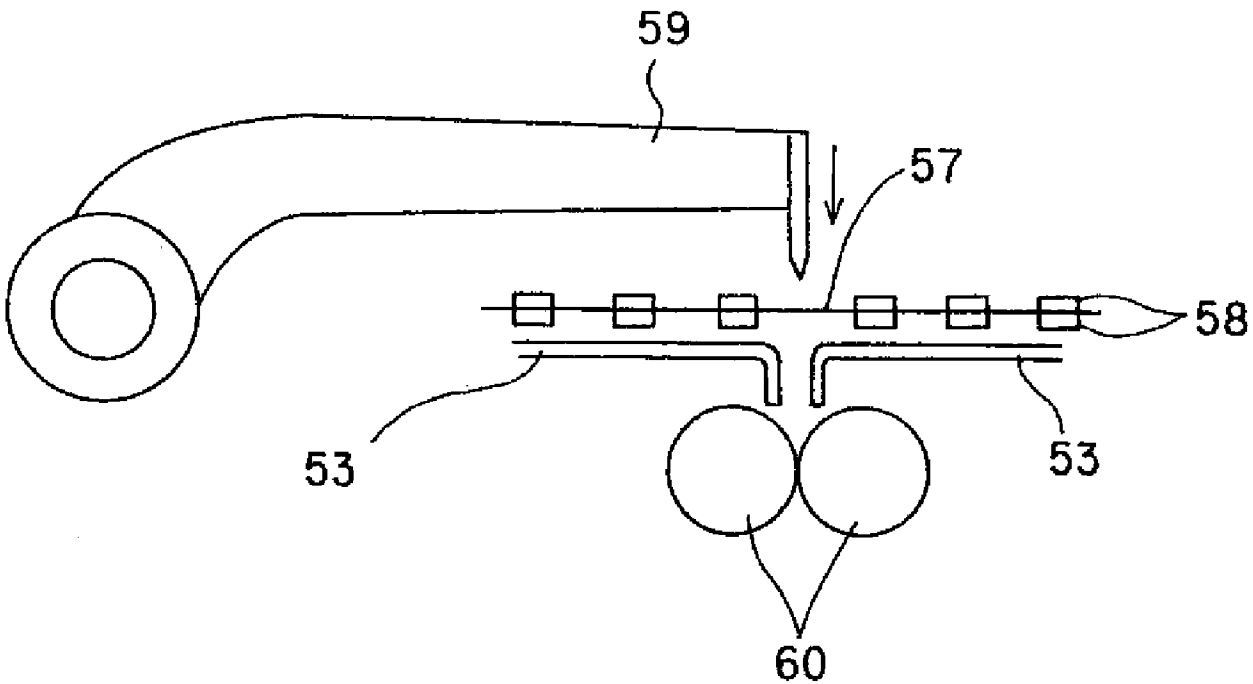
FIG. 11 Prior Art
FIG. 11 is a schematic side view of a conventional chopper device.

FIG. 1 is a plan view of a chopper table according to an embodiment of the present invention. FIG. 2 is a sectional view taken along line 1'-H of FIG. 1. FIG. 3 is a plan view of FIG. 2. FIG. 8 is a schematic side view of a chopper device equipped with the chopper table according to the present invention. The direction of transport of a signature is indicated by an open arrow in FIG. 1. A signature 13 is transported to a chopper table 1 by transport belts 12 paired vertically, and is chopper folded by a chopper blade 14 installed above the chopper table 1. The chopper table 1 is composed of a pair of table bodies 2 as guide tables, and inlet guides 3, as guides, installed in opposed relationship with each other nearly centrally of the table bodies 2. The chopper table 1 is supported on chopper frames 4, as locking members, at front and rear positions in the direction of transport. In detail, each of the inlet guides 3 extending in the direction of transport is supported by locking bolts 6 on brackets 5, as adjusting means, extending perpendicularly to the direction of transport at the front and rear positions of the inlet guide 3. Each of the locking bolts 6 has a head 6*a* and a threaded portion 6*b*, and an outside diameter portion of the head 6*a* fits into an inside diameter portion of an opening hole 3*e* opening in the inlet guide 3, while the threaded portion 6*b* is screwed into a threaded bore 5*c* opening in the bracket 5. The bracket 5 is supported on the chopper frame 4 by two adjusting bolts 7. The table body 2 is supported on the chopper frames 4, separately from the inlet guide 3, by locking bolts 8. That is, the table body 2 and the inlet guide 3 are each supported by the chopper frames 4.

To replace the transport belt 12 for transporting the signature 13, the locking bolts 8 are detached, where upon only the table body 2 can be removed. In detail, according to the earlier technology, the inlet guide is supported on the table body via a connecting member, so that when the table body is removed, the inlet guide is also dismounted at the same time. According to the present embodiment, by contrast, the table body 2 and the inlet guide 3 are supported separately. Thus, even when the table body 2 is removed from the chopper frames 4, the inlet guide 3 remains supported. Even if the table body 2 fails to be mounted on the chopper frames 4 with high accuracy, this failure does not affect the gap of a slit 3*a* (a slit as described earlier) formed between the inlet guides 3. Since the inlet guides 3 keep supported, the gap of the slit 3*a* therebetween remains unchanged.

In the event of a paper jam, each of the locking bolts 6 is released from the opening hole 3*e* and the threaded bore 5*c* by operating a wrench or the like, whereupon the inlet guide 3 is removed. At this time, the bracket 5 is kept supported on the chopper frames 4. After completion of corrective work, the inlet guide 3 can be installed at the original position existent before the work, simply by mounting the inlet guide 3 again on the brackets 5 by the locking bolts 6. In detail, the position of the inlet guide 3 relative to the bracket 5 is determined by the locking bolt 6 and the opening hole 3*e*, which are positioning means, so that the inlet guide 3 can be mounted at the same position as its position before its removal. That is, the bracket 5 is supported on the chopper frame 4, and the outside diameter portion of the head 6*a* fits into the inside diameter portion of the opening hole 3*e*. Thus, the returnability that the slit 3*a* between the inlet guides 3 remains unchanged is retained.

In changing folding specifications (from a many-page mode to a few-page mode or vice versa) or in assembling the components initially, it is necessary to adjust the slit 3*a*. For this purpose, the aforementioned adjusting bolts 7 for supporting the bracket 5 on the chopper frame 4 are attached parallel in the direction perpendicular to the direction of transport. A slot 5*a* is formed in the bracket 5 where a head 7*a* (see FIG. 4) of the adjusting bolt 7 is to be accommodated. An opening hole 3*b* opening in the inlet guide 3 is located above the slot 5*a*. The adjusting bolt 7 can be tightened or loosened by inserting a wrench or the like through the opening hole 3*b*.

Figure 4:
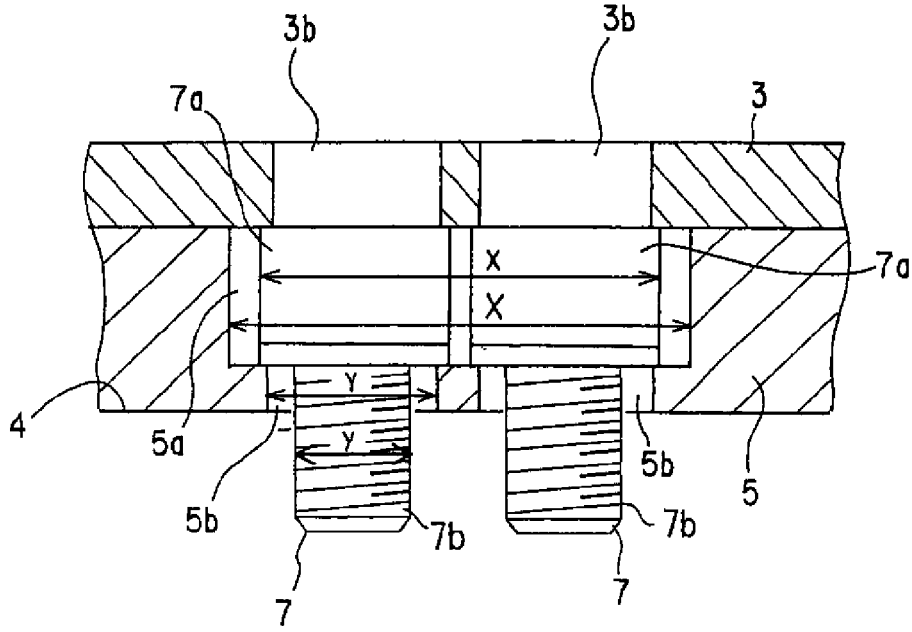
FIG. 4 is a sectional view of slots formed in a bracket.

A sectional view of the slot 5*a* formed in the bracket is shown in FIG. 4. The slot 5*a* is formed to satisfy the following conditions: Let the length of the slot 5*a* be X, and the length covering the outer peripheries of the two heads 7*a* be x. Then, X>x. Two slots 5*b* are formed below the slot 5*a*. The slot 5*b* is formed to satisfy the following conditions: Let the length of the slot 5*b* be Y, and the diameter of a threaded portion 7*b* of the adjusting bolt 7 be y. Then, Y>y. Since these conditions are fulfilled, mere loosening of the adjusting bolts 7 enables the bracket 5 to be moved in the direction perpendicular to the direction of transport of the signature 13.

As described above, the inlet guide 3 and the brackets are integrated by the locking bolt 6. Therefore, when the adjusting bolts 7 are loosened and the bracket 5 is moved in the direction perpendicular to the direction of transport, gap adjustment of the slit 3*a* can be made, with the inlet guide 3 being supported on the bracket 5.

The locking bolt 6 may be shaped such that the head 6*a* is fitted into the inlet guide 3 alone, and the threaded portion 6*b* is screwed into the inlet guide 3 and the bracket 5. The head 6*a* need not be conical as in the present embodiment, but for example, may be shaped like the head 7*a*. The adjusting bolt 7 may be in such a shape that the head 7*a* is accommodated in the hole opening in the inlet guide 3, and the threaded portion 7*b* communicates with the holes opening in the bracket 5 and is screwed into the chopper frame 4.

Second Embodiment

Figure 5:
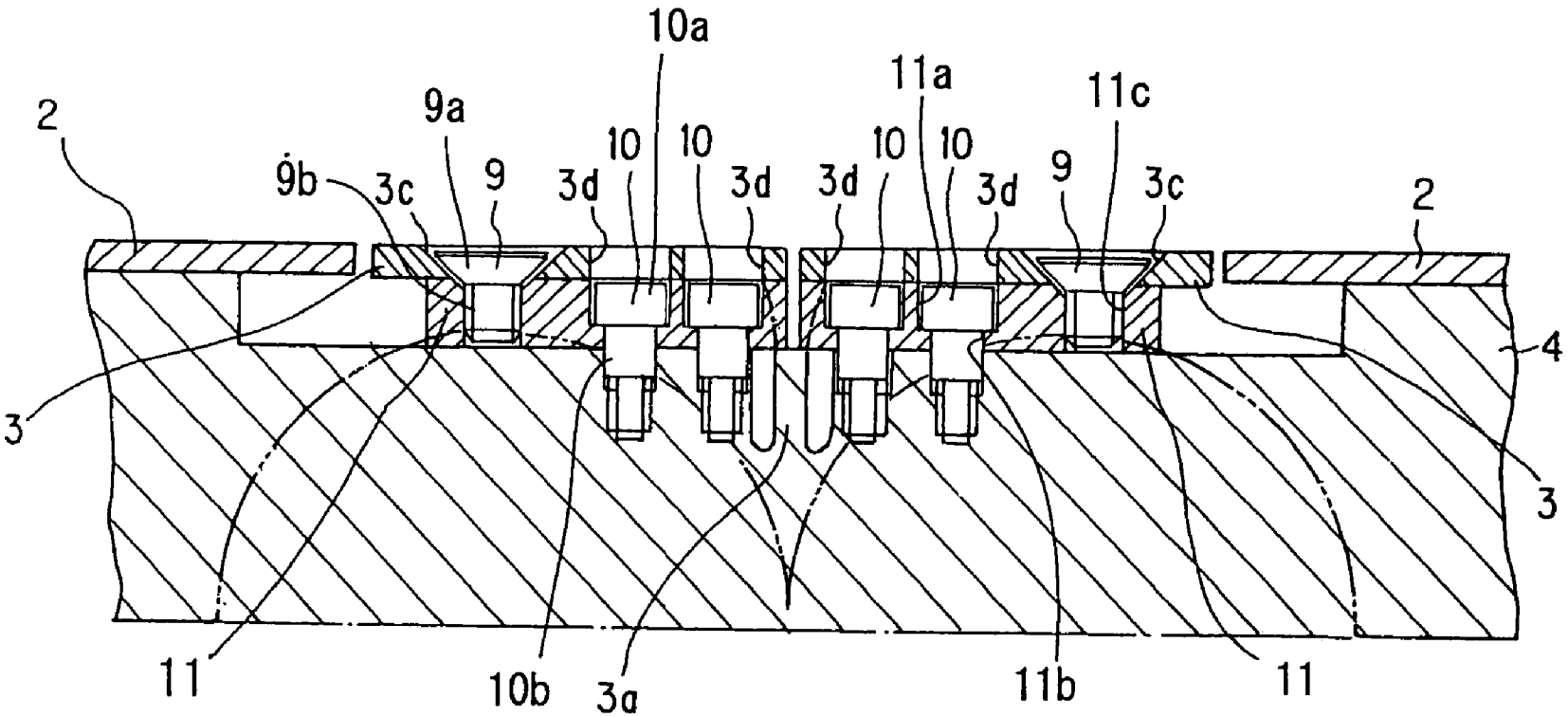
FIG. 5 is a sectional view taken at the same site as in FIG. 2 according to another embodiment of the present invention.
Figure 6:
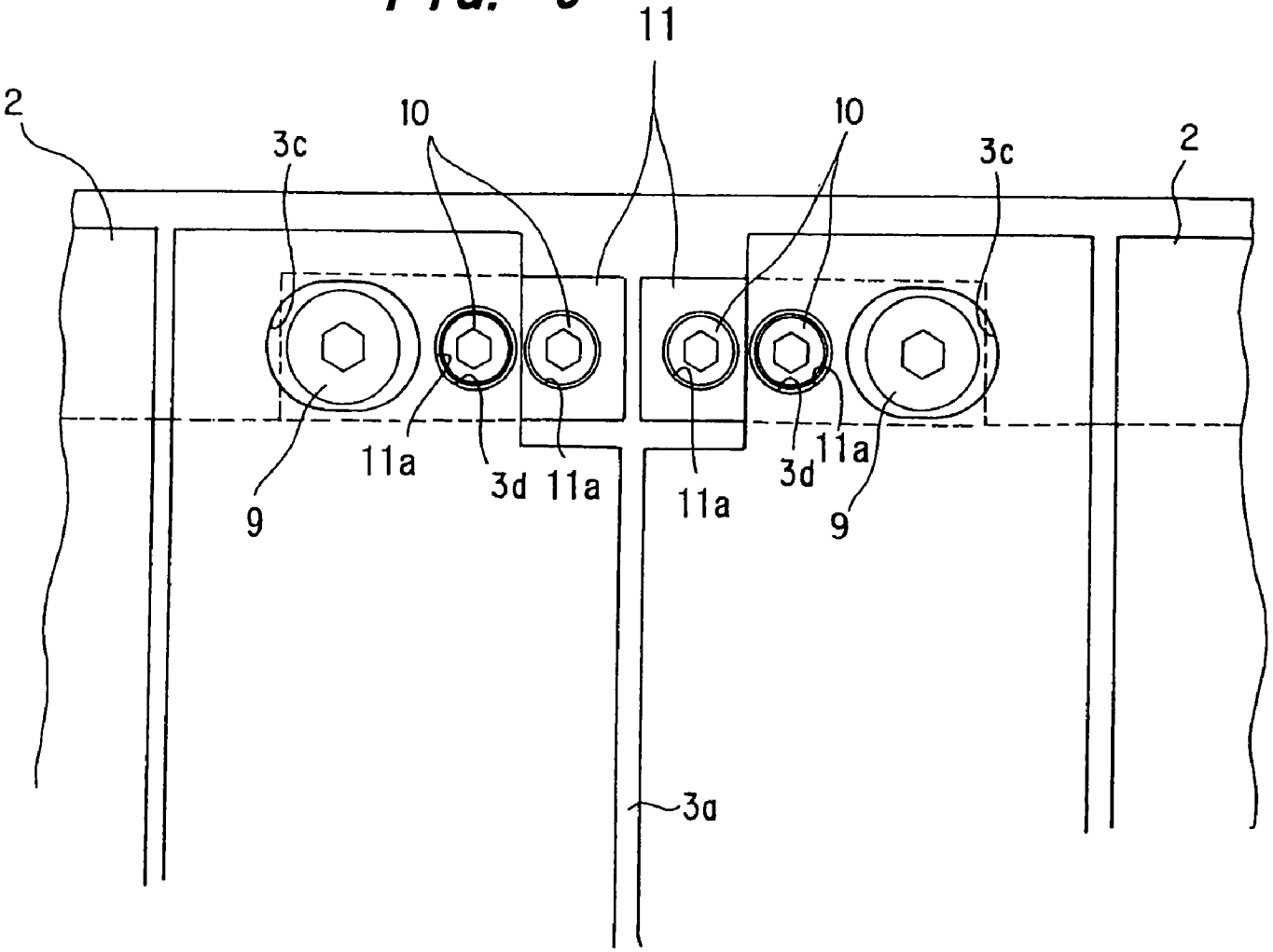
FIG. 6 is a plan view of FIG. 5.

Next, a second embodiment of the chopper table according to the present invention will be described. FIG. 5 shows a section at the same site as in FIG. 2 according to the second embodiment, and FIG. 6 shows a plan view of FIG. 5. In the second embodiment, the configuration and the manner of mounting of the chopper table 1 are the same as those described in the first embodiment.

As in the first embodiment, when the locking bolts (locking bolts 8 in FIG. 1) are detached, only the table body 2 can be removed. Since the table body 2 and the inlet guide 3 are supported separately, the inlet guide 3 keeps supported, so that the gap of the slit 3*a* remains unchanged. That is, even if the table body 2 fails to be mounted on the chopper frame 4 with high accuracy, this failure does not affect the gap of the slit 3*a* between the inlet guides 3.

Figure 7:
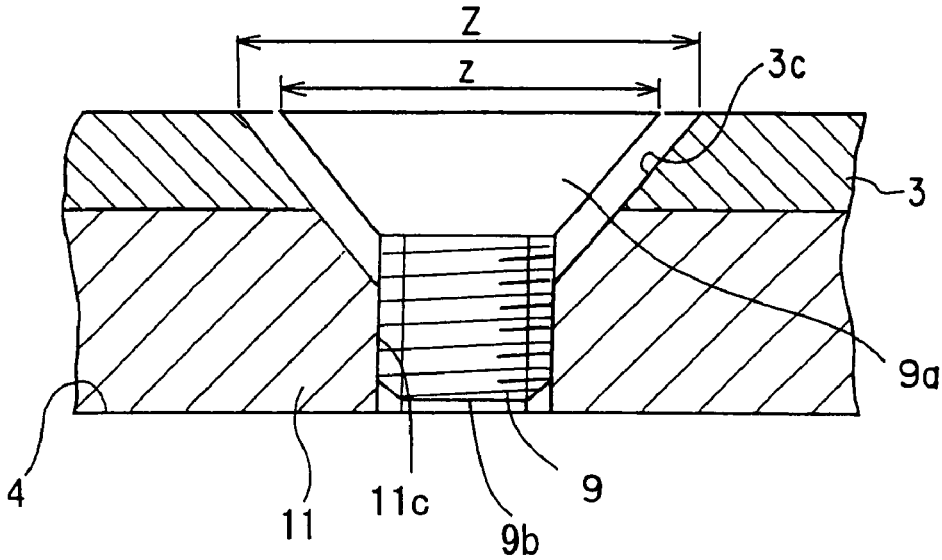
FIG. 7 is a sectional view of a slot formed in an inlet guide.

The features for making gap adjustment of the slit 3*a* will be described. The inlet guide 3 is supported on a bracket 11 by an adjusting bolt 9. Let the diameter of a head 9*a* of the adjusting bolt 9 be z, an opening hole of the inlet guide 3, where the head 9*a* of the adjusting bolt 9 is accommodated, be a slot 3*c*, and the length of the slot 3*c* be Z as shown in FIG. 7. In this case, the slot 3*c* is formed such that $Z > z$, as shown in FIG. 7. Below the slot 3*c*, a threaded bore 11*c*, into which a threaded portion 9*b* of the adjusting bolt 9 is screwed, is formed in the bracket 11.

With these features, when the gap adjustment of the slit 3*a* is to be made, the adjusting bolt 9 is loosened, and the inlet guide 3 is adjusted in the direction perpendicular to the direction of transport to determine the gap of the slit 3*a*. On this occasion, the bracket 11 is supported on the chopper frame 4 by locking bolts 10, so that only the inlet guide 3 moves. That is, gap adjustment in the second embodiment can be effected by the adjusting bolt 9 and the slot 3*c* as adjusting means.

Next, removal of the inlet guide 3 will be described. An opening hole 3*d* opening in the inlet guide 3 is formed above each of the four locking bolts 10. The locking bolt 10 has a head 10*a* and a threaded portion 10*b*, an outside diameter portion of the head 10*a* fits into an inside diameter portion of an opening hole 11*a* opening in the bracket 11, and an outside diameter portion of the threaded portion 10*b* fits into an inside diameter portion of a threaded bore 11*b* opening in the bracket 11 and screws into a threaded bore formed in the chopper frame 4. A wrench or the like is inserted into the opening hole 3*d* to detach the locking bolt 10 from the opening hole 11*a* and the threaded bore 11*b*. At this time, the inlet guide 3 is supported on the bracket 11 by the adjusting bolt 9, so that the inlet guide 3 and the bracket 11 are removed integrally. The locking bolt 10 can be positioned in place, because the outside diameter portion of the head 10*a* fits into the inside diameter portion of the opening hole 11*a*, and the outside diameter portion of the threaded portion 10*b* fits into the inside diameter portion of the threaded bore 11*b*. Thus, simply by mounting the integral combination of the inlet guide 3 and the bracket 11 on the chopper frame 4 by the locking bolts 10 at the original position existent before removal, the gap of the slit 3*a* is kept identical with that before removal. In detail, the position of the bracket 11 relative to the chopper frame 4 is determined by the locking bolts 10 and the opening holes 11*a*, 11*b*, which are positioning means, so that the bracket 11 can be mounted at the same position as its position before its removal. Thus, the returnability that the slit 3*a* remains unchanged before and after removal of the inlet guide 3 is retained.

The head 10*a* need not be shaped as in the present embodiment, but may be rendered conical like the aforementioned head 9*a*, for example.

In the above-described two embodiments, the direction of gap adjustment of the slit 3*a* between the inlet guides 3 is the direction perpendicular to the direction of transport of the signature. In other words, the longitudinal direction of the slit 3*a* and the direction of transport are horizontal with each other. However, the direction of gap adjustment may be horizontal with the direction of transport. This is a case where the longitudinal direction of the slit 3*a* is perpendicular to the direction of transport. That is, the same effects as in the embodiments can be obtained, if there is a positional relationship such that the direction of gap adjustment of the slit 3*a* is perpendicular to the longitudinal direction of the slit 3*a*.

While the present invention has been described by the above embodiments, it is to be understood that the invention is not limited thereby, but may be varied or modified in many other ways. Such variations or modifications are not to be regarded as a departure from the spirit and scope of the invention, and all such variations and modifications as would be obvious to one skilled in the art are intended to be included within the scope of the appended claims.

What is claimed is:

1. A chopper table, comprising:

a locking member;

a guide table, detachably supported by said locking member, for guiding a sheet transported by transport means;

a pair of guides for guiding, to a gap defined therebetween, said sheet guided to said guide table and pushed into said gap by a chopper blade;

adjusting means which detachably supports said pair of guides and supported on said locking member, the adjusting means allowing a position of said pair of guides to be changed by changing a position of the adjusting means relative to said locking member to adjust said gap formed between said pair of guides; and positioning means for determining a position of said pair of guides relative to said adjusting means, such that said pair of guides is mounted at a same position as an original position of said pair of guides before being removed.

2. The chopper table according to claim 1, wherein slots extending in a direction perpendicular to a longitudinal direction of said gap formed between said pair of guides are formed in said adjusting means, and at least one of said pair of guides is movable along a direction of extension of said slots with said at least one of said pair of guides being fixed to said adjusting means.

3. The chopper table according to claim 1, wherein said adjusting means has holes for insertion of an adjusting bolt, and said pair of guides have an opening hole for access to said adjusting bolt.

* * * * *